US008321968B2

(12) United States Patent
Park et al.

(10) Patent No.: US 8,321,968 B2
(45) Date of Patent: Dec. 4, 2012

(54) SELF-GENERATING BIDET

(75) Inventors: Man-Uk Park, Seoul (KR); Sung-Worl Jin, Seoul (KR); Young-Sang Yun, Seoul (KR); Ji-Hye Jeong, Seoul (KR); In-Seok Seo, Seoul (KR); Ki-Chul Kim, Seoul (KR); Joung-Ho Son, Seoul (KR)

(73) Assignee: Woongjin Coway Co., Ltd., Choongcheongnam-do (KR)

( * ) Notice: Subject to any disclaimer, the term of this patent is extended or adjusted under 35 U.S.C. 154(b) by 0 days.

(21) Appl. No.: 13/086,974

(22) Filed: Apr. 14, 2011

(65) Prior Publication Data

US 2011/0252556 A1 Oct. 20, 2011

(30) Foreign Application Priority Data

Apr. 15, 2010 (KR) ..... 10-2010-0035008
Jun. 29, 2010 (KR) ..... 10-2010-0061841

(51) Int. Cl.
*A47K 3/022* (2006.01)

(52) U.S. Cl. ..... 4/443

(58) Field of Classification Search ..... 4/443–448
See application file for complete search history.

(56) References Cited

U.S. PATENT DOCUMENTS

2005/0246828 A1 11/2005 Shirai
2009/0076468 A1* 3/2009 Hoffoss ..... 604/310
2010/0235978 A1* 9/2010 Guttau et al. ..... 4/420.4

FOREIGN PATENT DOCUMENTS

| | | |
|---|---|---|
| EP | 0433631 | 6/1991 |
| EP | 0675234 | 10/1995 |
| EP | 0675234 A1 * | 10/1995 |
| JP | 11-081422 | 3/1999 |
| JP | 11222902 | 8/1999 |
| JP | 2000120136 | 4/2000 |
| JP | 2000120149 | 4/2000 |
| JP | 2001193131 | 7/2001 |
| JP | 2009281139 | 12/2009 |
| KR | 20-0366363 | 11/2004 |
| KR | 10-0817523 | 3/2008 |

* cited by examiner

*Primary Examiner* — Lori Baker
(74) *Attorney, Agent, or Firm* — Dority & Manning, P.A.

(57) ABSTRACT

There is provided a self-generating bidet that can perform power-generation using water supplied to the bidet or a water tank. The self-generating bidet, injecting water through a nozzle part, includes a water inlet into which water is introduced; a generator generating power through the water introduced by the water inlet; a charging unit storing electricity generated from the generator; and a nozzle passage part provided between the generator and the nozzle part to supply the water passing through the generator to the nozzle part. The self-generating bidet further includes a controller controlling the generator to be driven by opening a passage of the nozzle passage part in order to allow the water to be discharged through the nozzle part when a voltage of the charging unit is lower than a predetermined reference voltage.

20 Claims, 10 Drawing Sheets

SELF-GENERATING BIDET

CROSS-REFERENCE TO RELATED APPLICATIONS

This application claims the priority of Korean Patent Application Nos. 10-2010-0035008 filed on Apr. 15, 2010 and 10-2010-0061841 filed on Jun. 29, 2010, in the Korean Intellectual Property Office, the disclosures of which are incorporated herein by reference.

BACKGROUND OF THE INVENTION

1. Field of the Invention

The present invention relates to a bidet capable of generating power through power generation, and more particularly, to a self-generating bidet generating power using water supplied to a toilet stool (toilet seat) and/or a bidet.

2. Description of the Related Art

Generally, a bidet is an apparatus for washing a human anus and/or a female pudendum.

An example of a bidet may include a mechanical bidet that injects water by allowing a user to directly operate a lever, or the like and an electronic bidet that automatically performs various functions installed at the bidet, for example, a bidet function, a anus-washing function, a nozzle-cleaning function, a drying function, or the like, when the user presses buttons performing specific functions.

However, since the mechanical bidet does not have a separate external power supply, it is inconvenient for a user to control all the operations, as, since the electronic bidet can be operated only when it is connected to an external power supply, it cannot be used in an area in which there are no power supplying facilities or in which it is inconvenient to connect the bidet to a power supply.

In order to solve the difficulty in connecting the electronic bidet to the power supply, a method for operating various functions of a bidet by using a battery has been considered. In this case, however, the inconvenience of frequently replacing the battery is encountered.

In order to solve the problems, a generating type bidet that supplies electricity by generating power using a pressure of water supplied from a water supplying part, or the like, has been proposed. In the generating type bidet, a generator is directly installed at a pipe connecting a water tank for flushing a bowl of the toilet stool to a water inlet such as a water supplying part, or the like. However, many efforts and difficulties in installing the generator at the pipe installed at the outside of the bidet and connecting the wiring of the generator to a charging unit inside the bidet are caused. Further, since the charging unit storing electricity generated from the generator is disposed in the main body of the bidet, the wiring electrically connecting the generator to the charging unit is exposed to the outside of the main body of the bidet. In this case, there are several problems in that the appearance may be spoiled, the external wiring may be cut due to carelessness or a mistake by the user, and the user may also fall over the wiring.

In particular, there is a problem in that the above-mentioned generating type bidet cannot be installed in the toilet stool of a toilet lacking a water tank.

The generating type bidet should minimize power consumption since the capacity of power generated from the generator is very small. However, the generating type bidet wastes considerable amounts of power, since standby power is supplied to various kinds of electric devices to which electricity is supplied. In particular, since the overall time taken in the use of the bidet is very small during the day, it is inefficient to waste a considerable amount of standby power in order to merely use the bidet when considering insufficient generating capacity, which is a serious obstacle to the widespread adoption of the generating type bidet.

Further, the electronic bidet has various valves in order to inject water and controls water injecting pressure using a flux control valve. However, the flux control valve controls the opening and closing rate of the valve by driving a motor, thereby consuming a considerable amount of power. Therefore, the flux control value cannot be used for the generating type bidet that has insufficient generating capacity.

In particular, since the generating type bidet according to the related art generates power using only the water supplied to the water tank, the generating capacity is insufficient. Further, it is impossible to use the bidet in a state in which the charging voltage is low.

SUMMARY OF THE INVENTION

An aspect of the present invention provides a self-generating bidet that can be used stably by securing sufficient electricity generating capacity by discharging water through a nozzle part.

Another aspect of the present invention provides a self-generating bidet that can be stably used by generating power when a voltage of a stored charge is insufficient to use the bidet.

Another aspect of the present invention provides a self-generating bidet having an improved appearance in which a generator and the wiring thereof, making connections with a charging unit, are not exposed to the outside, as well as preventing shorts in the wiring.

Another aspect of the present invention provides a self-generating bidet capable of minimizing power consumption by minimizing the consumption of standby power.

Another aspect of the present invention provides a self-generating bidet capable of minimizing power consumed in driving a valve for opening and closing a passage.

Another aspect of the present invention provides a self-generating bidet capable of controlling flux while minimizing the use of power.

Another aspect of the present invention provides a self-generating bidet capable of generating power even in a toilet stool having no water tank.

Another aspect of the present invention provides a self-generating bidet having no defects in a generator even when hot water is supplied thereto.

Another aspect of the present invention provides a self-generating bidet capable of preventing damage to various components such as a valve and the like and the generation of noise due to external water pressure.

Another aspect of the present invention provides a self-generating bidet capable of confirming whether a charging unit is abnormal.

Another aspect of the present invention provides a self-generating bidet capable of confirming when generating capacity is insufficient for the use of the bidet.

According to an aspect of the present invention, there is provided self-generating bidet, the bidet injecting water through a nozzle part, including: a water inlet into which water is introduced; a generator generating power through the water introduced into the water inlet; a charging unit storing electricity generated from the generator; and a nozzle passage part provided between the generator and the nozzle part to supply the water passing through the generator to the nozzle part.

The self-generating bidet may further include a tank passage part provided between the generator and a water tank to supply the water passing through the generator to the water tank for washing a toilet stool, and the self-generating bidet may generate power through the water flowing in the tank passage part and the nozzle passage part.

The self-generating bidet may further include a water flushing passage part provided between the generator and a bowl of a toilet stool to supply the water passing through the generator to the bowl of the toilet stool, wherein the self-generating bidet may generate power through the water flowing in the water flushing passage part and the nozzle passage part.

The self-generating bidet may further include a controller controlling the generator to be driven by opening a passage of the nozzle passage part in order to allow the water to be discharged through the nozzle part when a voltage of the charging unit is lower than a predetermined reference voltage. Alternatively, the self-generating bidet may further include a controller controlling the generator to be driven by opening a passage of the nozzle passage part in order to allow the water to be discharged through the nozzle part when a predetermined condition is satisfied.

The nozzle part may include an injection nozzle and a cleaning nozzle cleaning the injection nozzle, and the controller may control the generator to be driven by allowing the water to be discharged through the cleaning nozzle when the voltage of the charging unit is lower than the predetermined reference voltage.

The self-generating bidet may further include a sensing sensor sensing whether a user wishes to use the bidet by sensing whether the user is seated on a bidet seat, whether the user has approached within a predetermined distance of the bidet, or whether the user has applied signals to the bidet through a remote controller, wherein the controller allows the power to be supplied from the charging unit when the sensing sensor senses the user's use of the bidet, and interrupts the power supplied from the charging unit when a predetermined standby time elapses after the sensing sensor senses the user's termination of the use of the bidet. The sensing sensor may include a tactile switch that performs switching by being pressed when the user is seated on the bidet seat.

The nozzle passage part may include a first opening and closing valve opening and closing an injection nozzle passage connected to the injection nozzle such that the water is or is not supplied to the injection nozzle, and a second opening and closing valve opening and closing a cleaning nozzle passage connected to the cleaning nozzle such that the water is or is not supplied to the cleaning nozzle. Here, the first opening and closing valve and the second opening and closing valve may be formed as latch valves in order to reduce power consumption.

The nozzle passage part may further include a flux control valve disposed at a latter portion of the first opening and closing valve so as to control a flux of the water supplied to the injection nozzle. Here, the flux control valve may be formed as a latch valve including a first passage which is in an open state and a second passage which is opened by power applied thereto.

The nozzle part may include an injection nozzle and a nozzle driver moving the injection nozzle forwards and backwards, and the controller may control a driving of the nozzle driver such that a moving distance of the injection nozzle is made to be different at the time of using an anus-washing function and a bidet function in order to implement the anus-washing function and the bidet function through a single injection nozzle. Here, the nozzle driver may include a DC motor.

The tank passage part may include a tank passage having a diameter larger than that of a nozzle passage included in the nozzle passage part. Here, a ratio of the diameter of the nozzle passage of the nozzle passage part to the diameter of the tank passage of the tank passage part may be 1:1.2 to 5. The water flushing passage part may include a water flushing passage having a diameter larger than that of a nozzle passage included in the nozzle passage part.

The generator, the charging unit, the nozzle part, the nozzle passage part, and the tank passage part or the water flushing passage part may be provided within a bidet housing.

According to another aspect of the present invention, there is provided a self-generating bidet, the bidet injecting water through a nozzle part, including: a water inlet into which water is introduced; a generator generating power through the water introduced into the water inlet; a charging unit storing electricity generated from the generator; a hot water inlet into which hot water is introduced; a mixing valve installed at a latter portion of the generator to mix the water introduced from the water inlet with the hot water introduced from the hot water inlet; and a nozzle passage part supplying the water passing through the mixing valve to the nozzle part.

The self-generating bidet may further include a tank passage part provided between the generator and a water tank to supply the water passing through the generator to the water tank for washing a toilet stool, and the self-generating bidet may generate power through the water flowing in the tank passage part and the nozzle passage part. Alternatively, the self-generating bidet may further include a water flushing passage part provided between the generator and a bowl of a toilet stool to supply the water passing through the generator to the bowl of the toilet stool, wherein the self-generating bidet may generate power through the water flowing in the water flushing passage part and the nozzle passage part.

The self-generating bidet may further include a pressure reducing valve installed at an previous portion of the generator in a high water pressure area such that noise generated in the generator is decreased by reducing pressure of the water introduced to the generator. The self-generating bidet may further include a pressure reducing valve installed at the latter portion of the generator in a low water pressure area such that the pressure of the water is directly transferred to the generator to enhance power generating efficiency and the pressure of the water passing through the generator is reduced to protect components provided in the nozzle passage part.

The self-generating bidet may further include a controller controlling the generator to be driven by opening a passage of the nozzle passage part in order to allow the water to be discharged through the nozzle part when a voltage of the charging unit is lower than a predetermined reference voltage.

The nozzle part may include an injection nozzle and a cleaning nozzle cleaning the injection nozzle, and the controller may control the generator to be driven by allowing the water to be discharged through the cleaning nozzle when the voltage of the charging unit is lower than the predetermined reference voltage.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Hereinafter, exemplary embodiments of the present invention will be described in detail with reference to the accompanying drawings.

Figure 1:
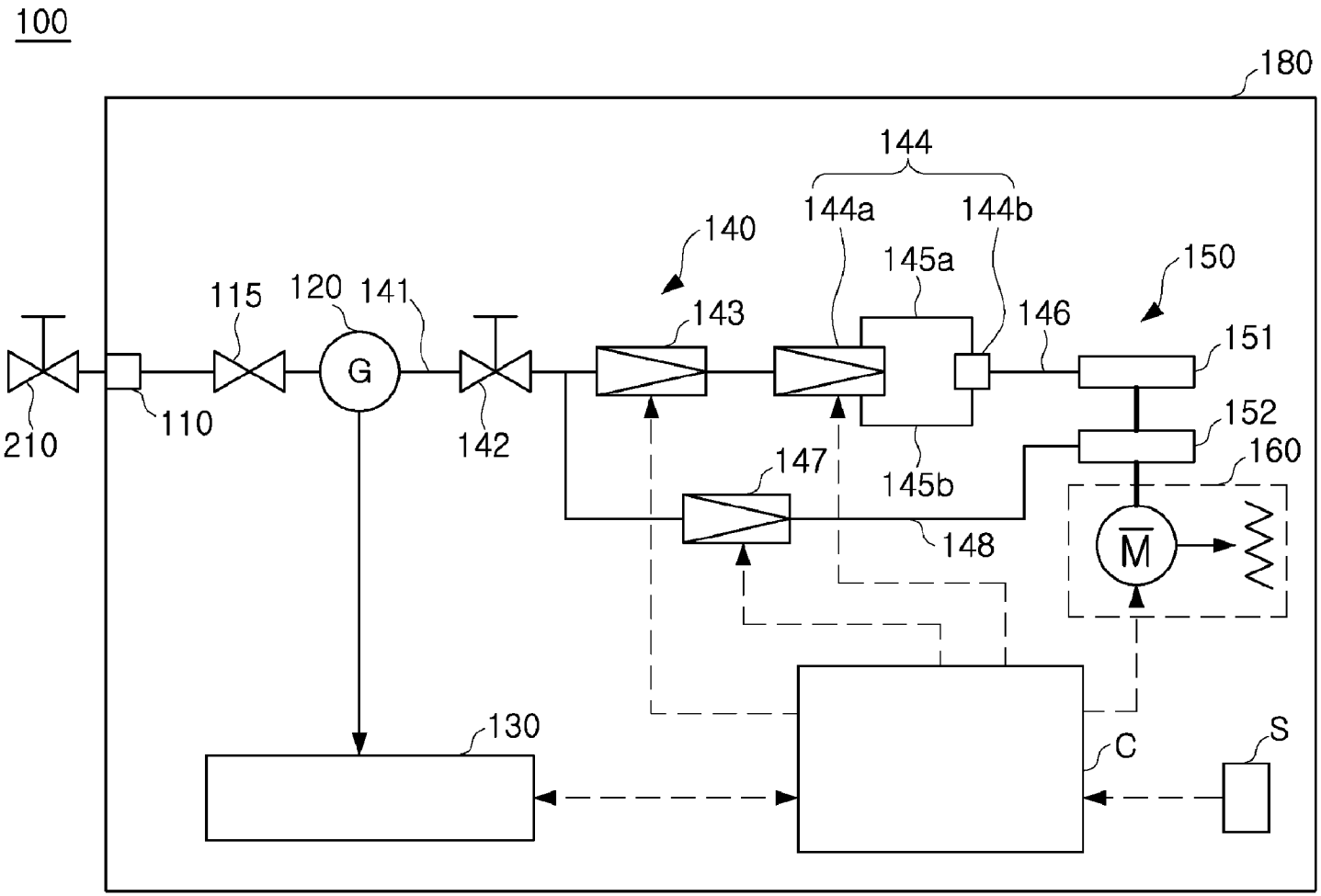
FIG. 1 is a schematic diagram showing a self-generating bidet according to an exemplary embodiment of the present invention.
Figure 4:
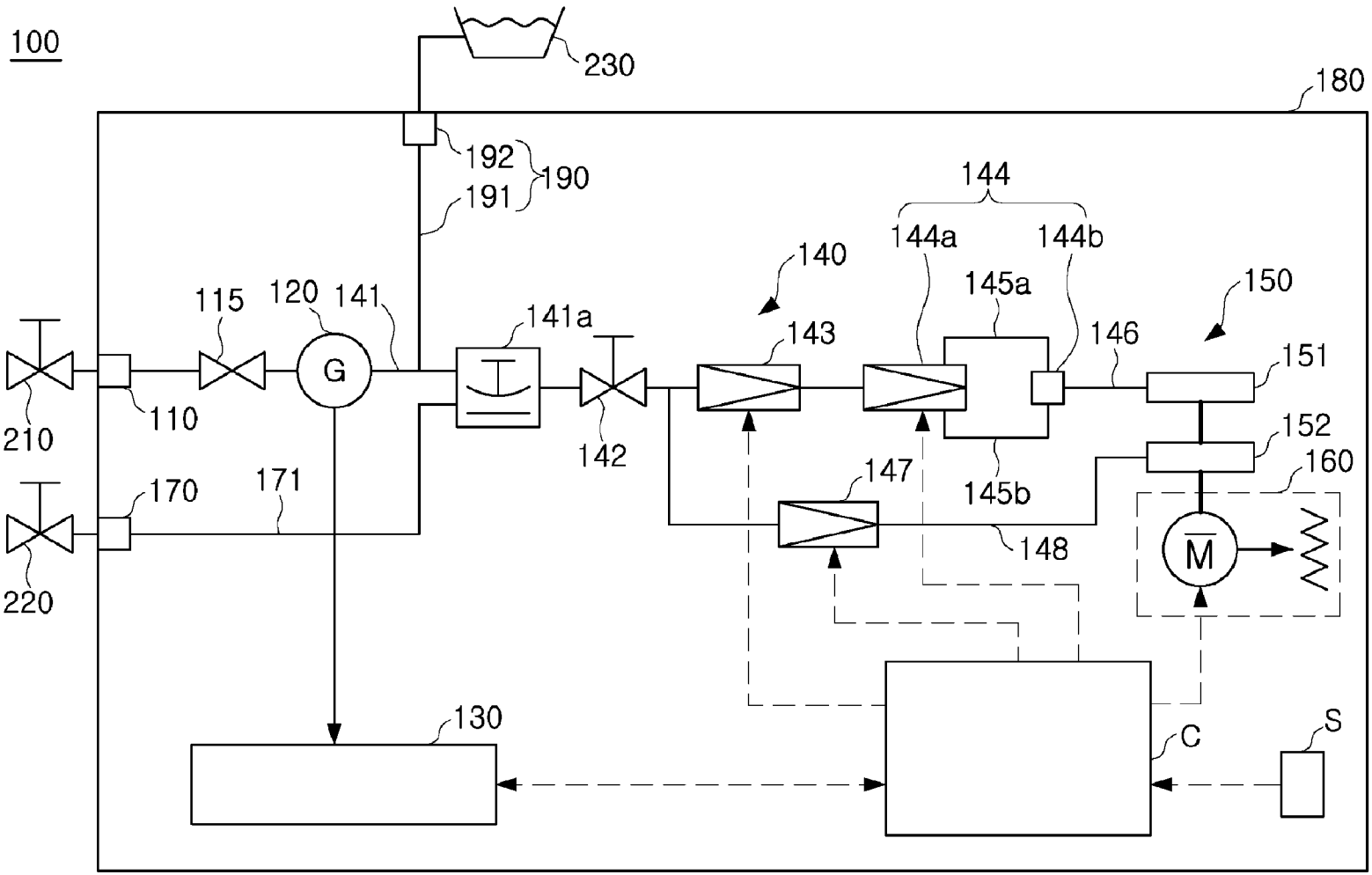
Figure 5:
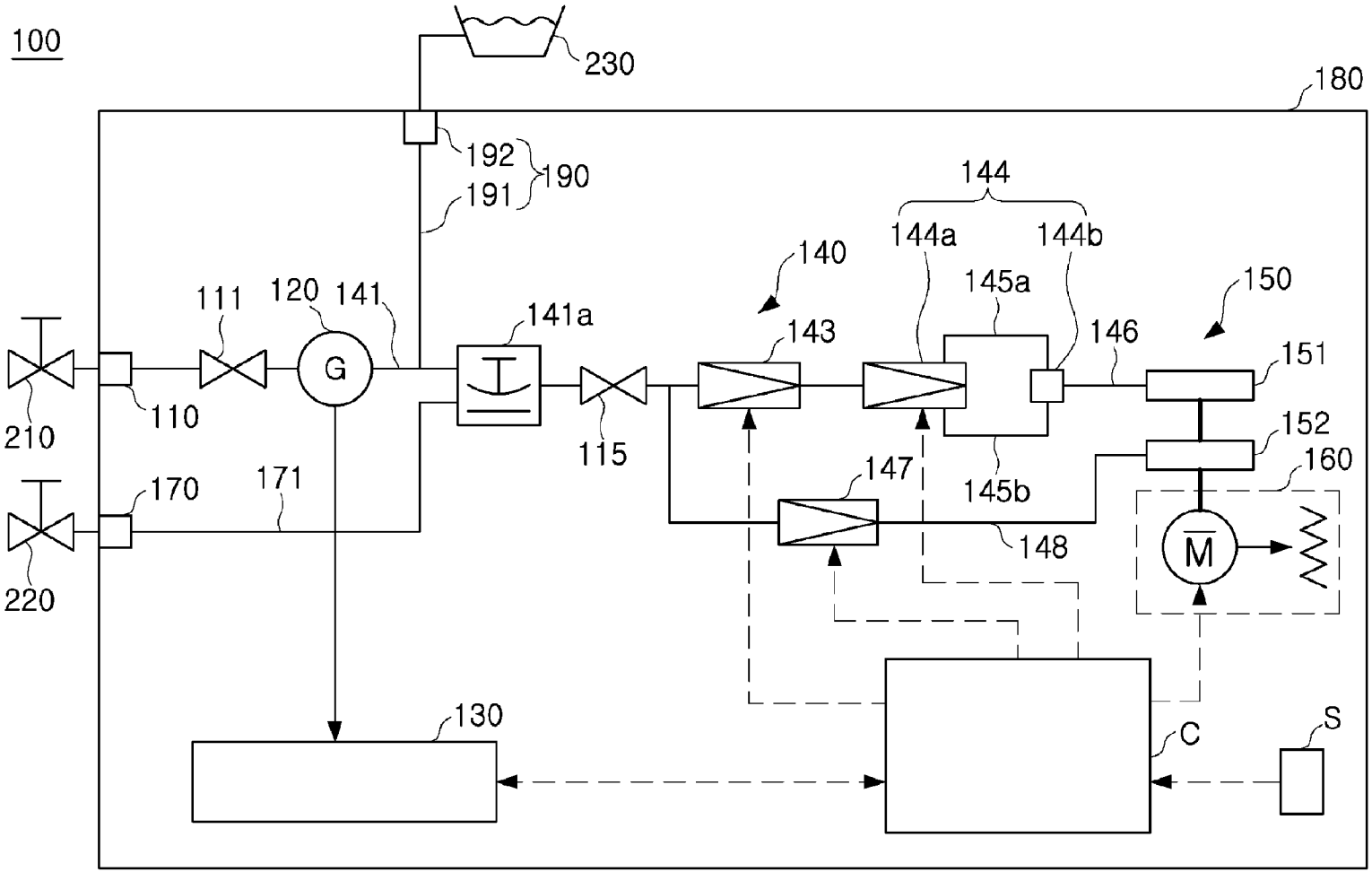
Figure 6:
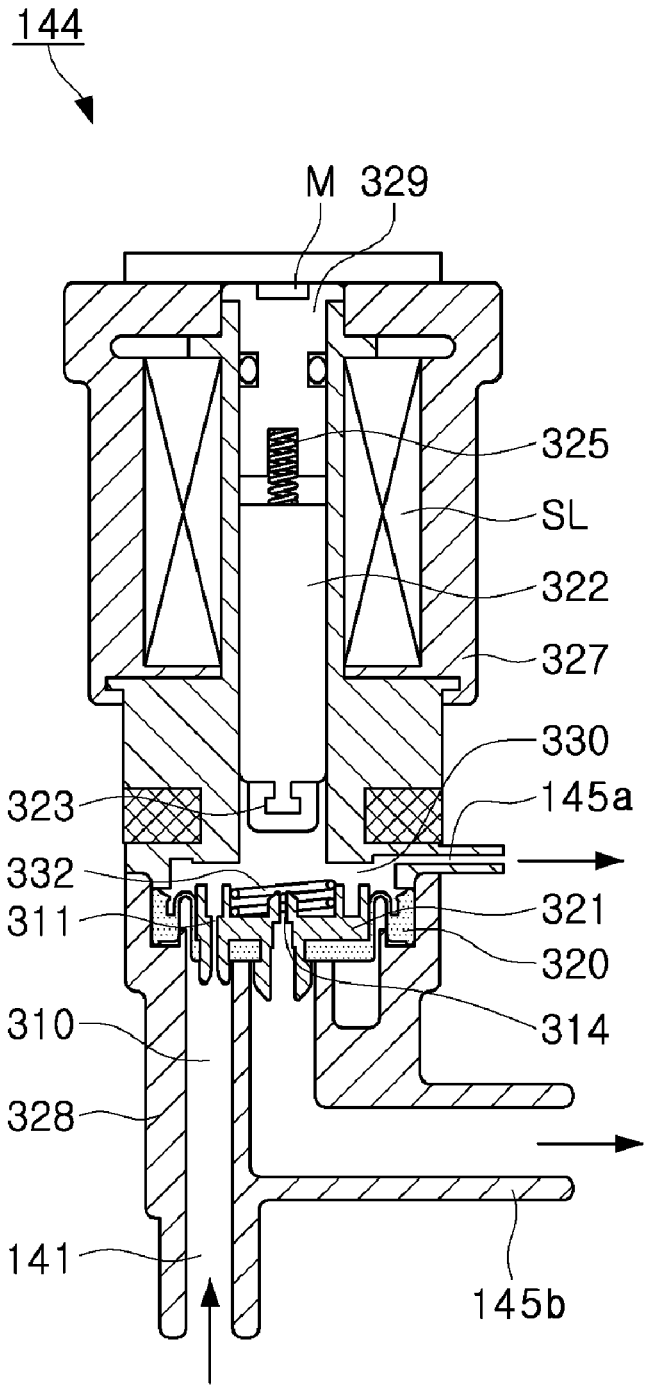
FIG. 6 is a cross-sectional view showing an exemplary embodiment of a flux control valve shown in FIGS. 1 through 5.
Figure 7:
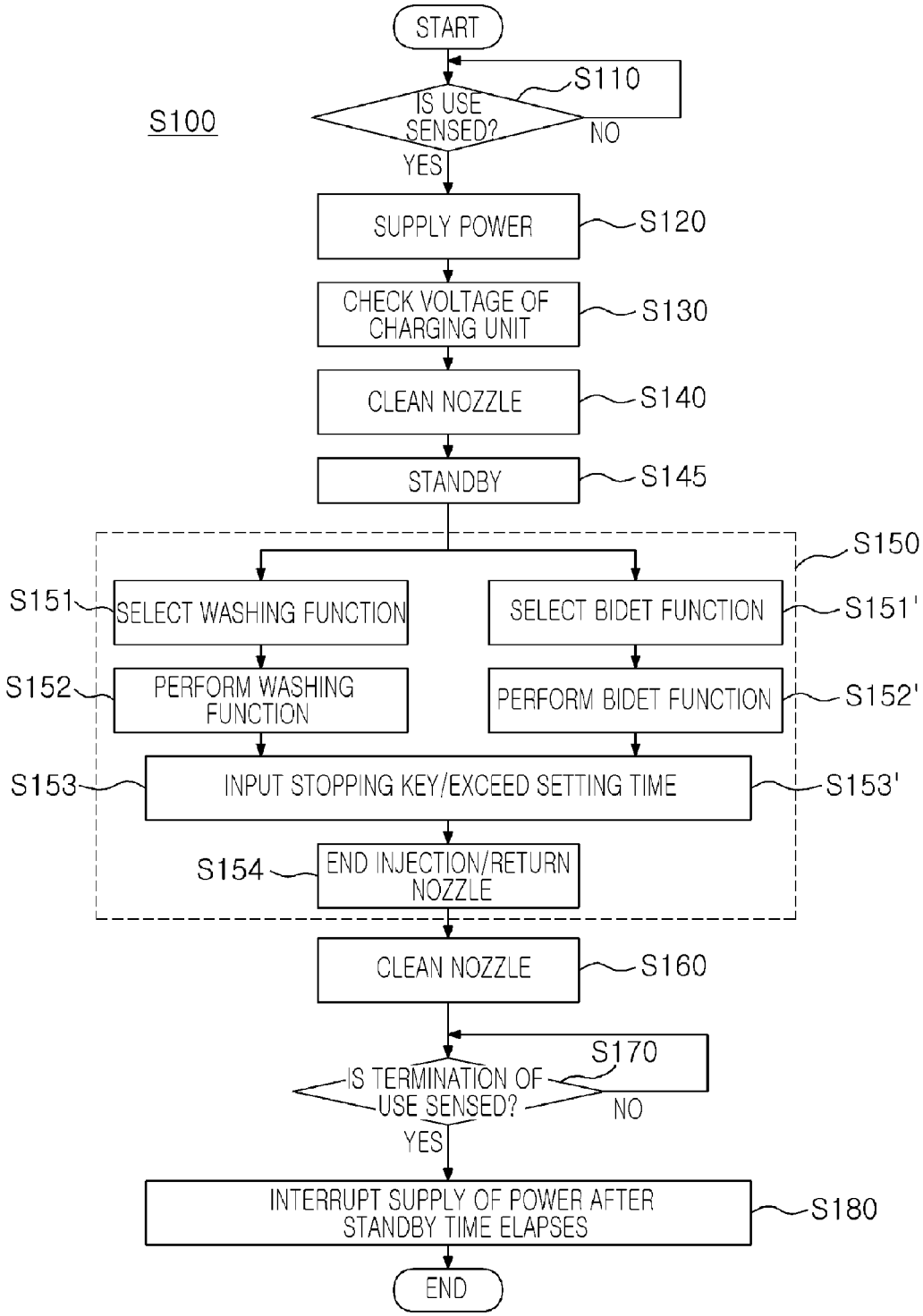
FIG. 7 is a flow chart showing a controlling method applicable to a self-generating bidet according to an exemplary embodiment of the present invention.
Figure 8:
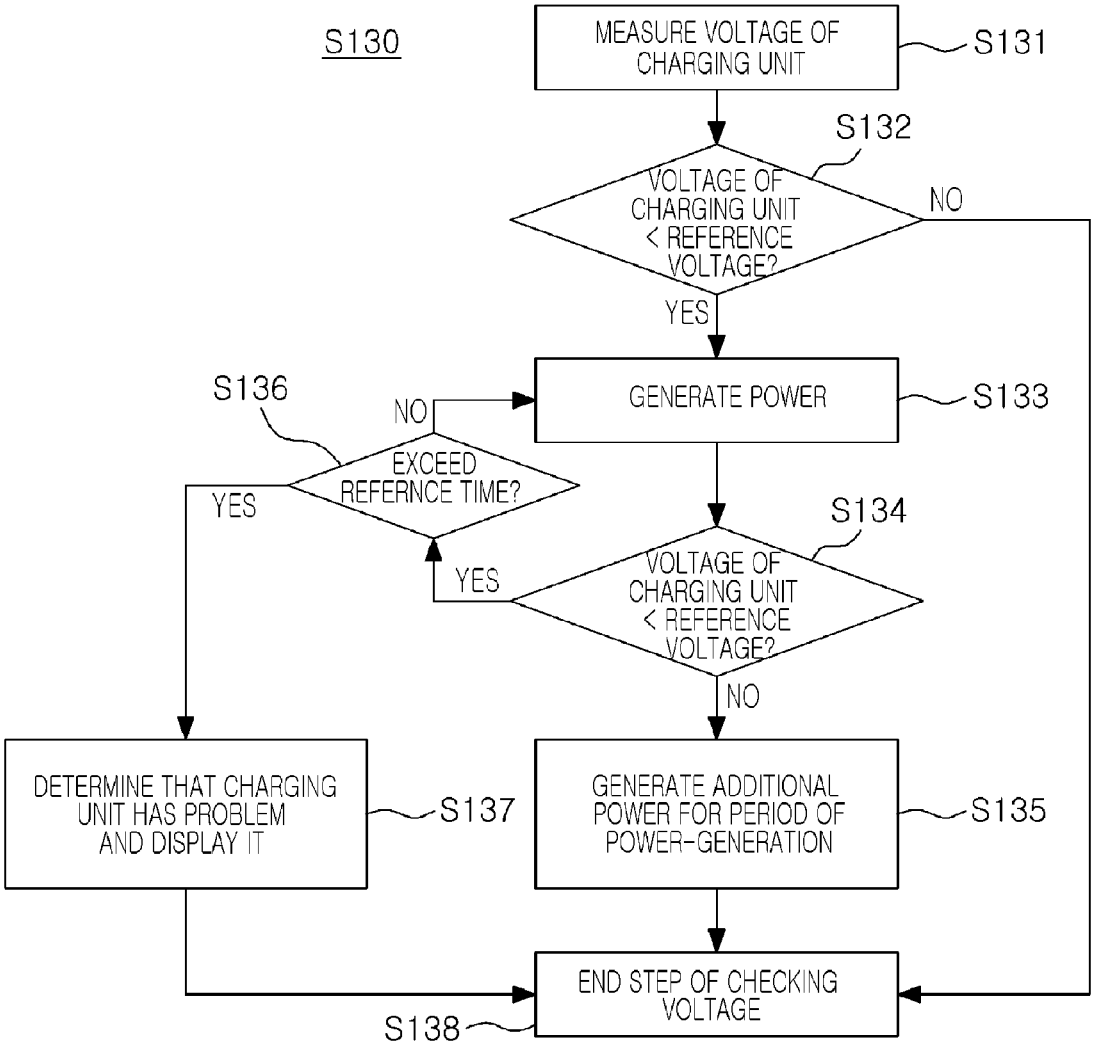
FIG. 8 is a flow chart showing an exemplary embodiment of a process of checking voltage of a charging unit shown in FIG. 7.
Figure 9:
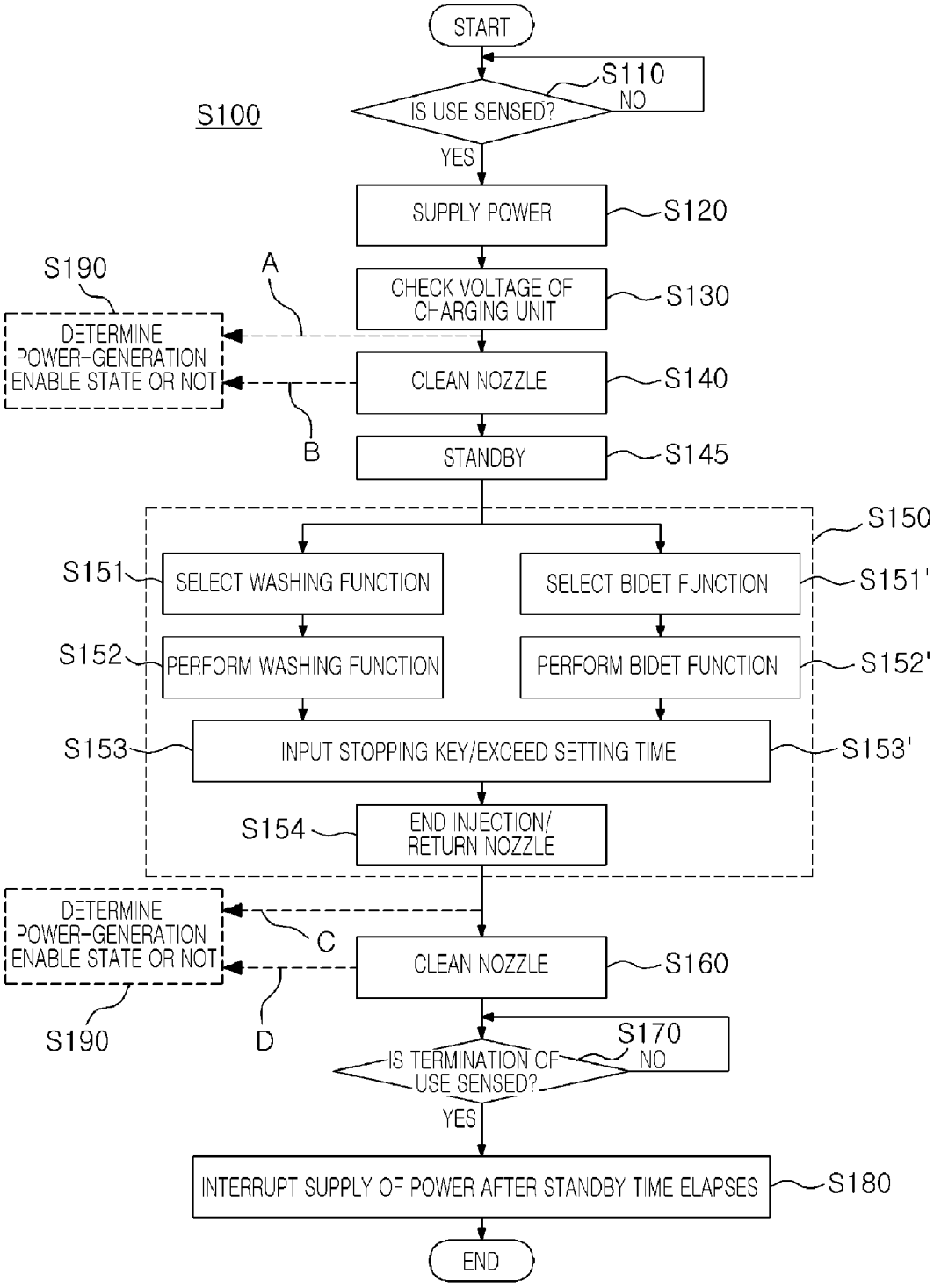
FIG. 9 is a flow chart showing a controlling method applicable to a self-generating bidet according to another exemplary embodiment of the present invention.
Figure 10:
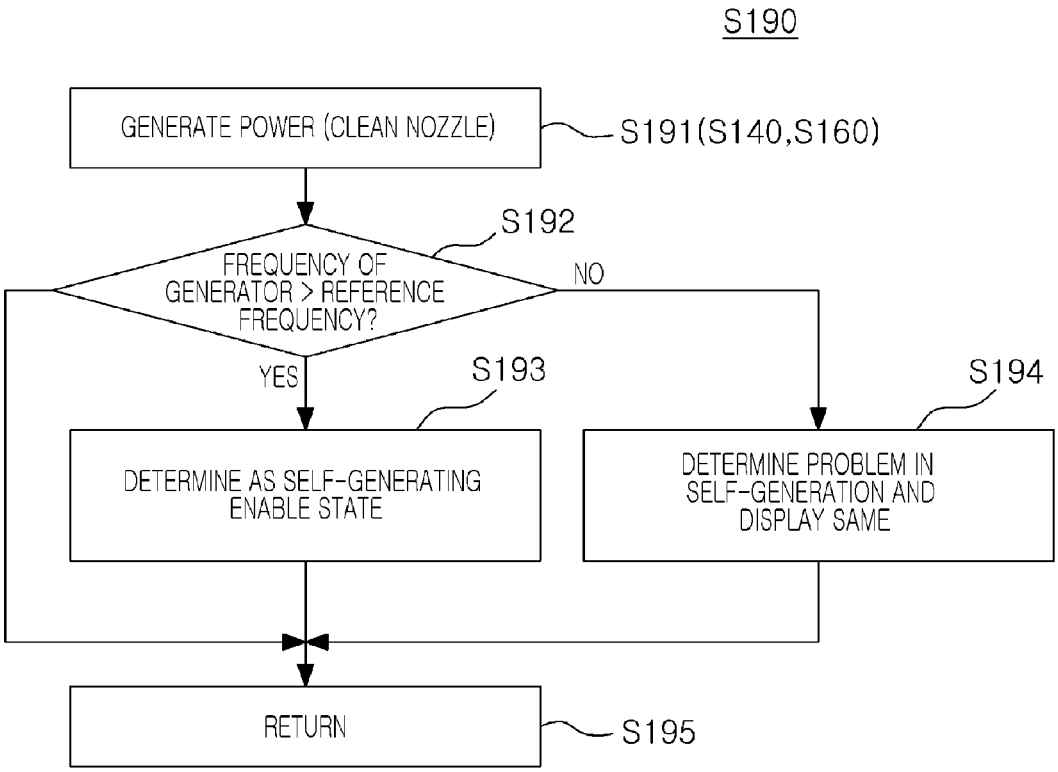
FIG. 10 is a flowchart showing an exemplary embodiment of a process of determining whether the bidet shown in FIG. 9 is self-generated.

FIG. 1 is a schematic diagram showing a self-generating bidet according to an exemplary embodiment of the present invention, FIGS. 2 through 5 are schematic diagrams showing a self-generating bidet according to another exemplary embodiment of the present invention, and FIG. 6 is a cross-sectional view showing an exemplary embodiment of a flux control valve shown in FIGS. 1 through 5. Further, FIG. 7 is a flow chart showing a controlling method applicable to a self-generating bidet according to an exemplary embodiment of the present invention, FIG. 8 is a flow chart showing an exemplary embodiment of a process of checking voltage of a charging unit shown in FIG. 7, FIG. 9 is a flow chart showing a controlling method applicable to a self-generating bidet according to another exemplary embodiment of the present invention, and FIG. 10 is a flow chart showing an exemplary embodiment of a process of determining whether the bidet shown in FIG. 9 is self-generated.

A self-generating bidet according to exemplary embodiments of the present invention will first be described below with reference to FIGS. 1 through 6. Thereafter, a controlling method applicable to a self-generating bidet according to exemplary embodiments of the present invention will be described with reference to FIGS. 7 through 10.

First, a self-generating bidet 100 according to an exemplary embodiment of the present invention will be described with reference to FIGS. 1 through 3.

As shown in FIG. 1, the self-generating bidet 100 according to the exemplary embodiment of the present invention may include a water inlet 110 into which water is introduced, a generator 120 that generates power by the water introduced into the water inlet 110, a charging unit 130 that charges electricity generated from the generator 120, a nozzle part 150 that is configured to inject the water introduced into the water inlet 110 to a human body, and a nozzle passage part 140 provided between the generator 120 and the nozzle part 150 to supply the water passing through the generator 120 to the nozzle part 150. The self-generating bidet 100 may further include a controller C that controls the opening and closing of the passage of the nozzle passage part 140 to drive the generator 120. In addition, as shown in FIG. 2, the self-generating bidet 100 according to the exemplary embodiment of the present invention may include a tank passage part 190 provided between the generator 120 and a water tank 230 to supply the water passing through the generator 120 to the water tank 230 for washing a bowl of the toilet stool. In addition, as shown in FIG. 3, the self-generating bidet 100 according to the exemplary embodiment of the present invention may also include a water flushing passage part 190' provided between the generator 120 and a bowl 240 to supply the water passing through the generator 120 to the bowl 240 of the toilet stool.

Figure 2:
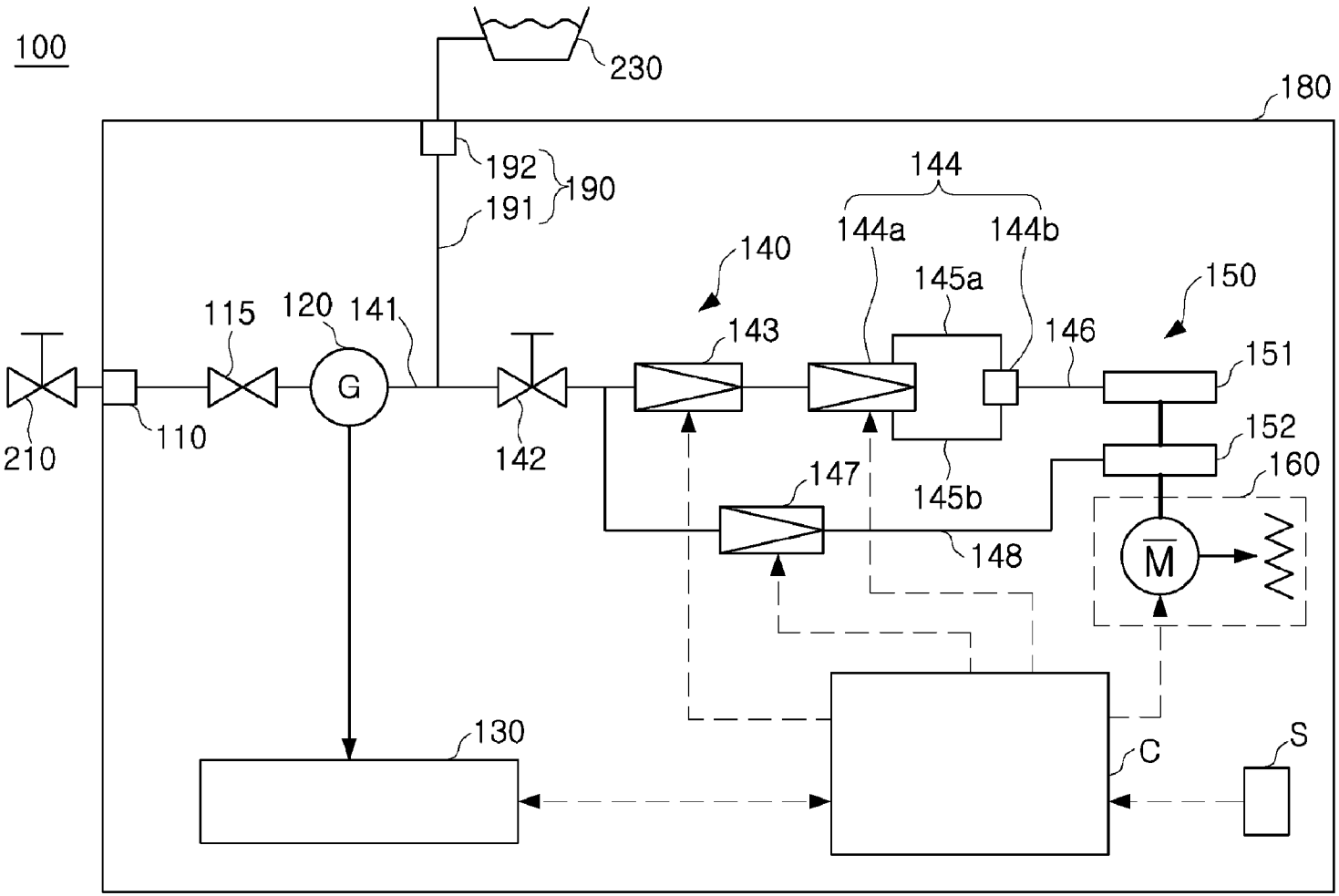
FIGS. 2 through 5 are schematic diagrams showing a self-generating bidet according to another exemplary embodiment of the present invention.
Figure 3:
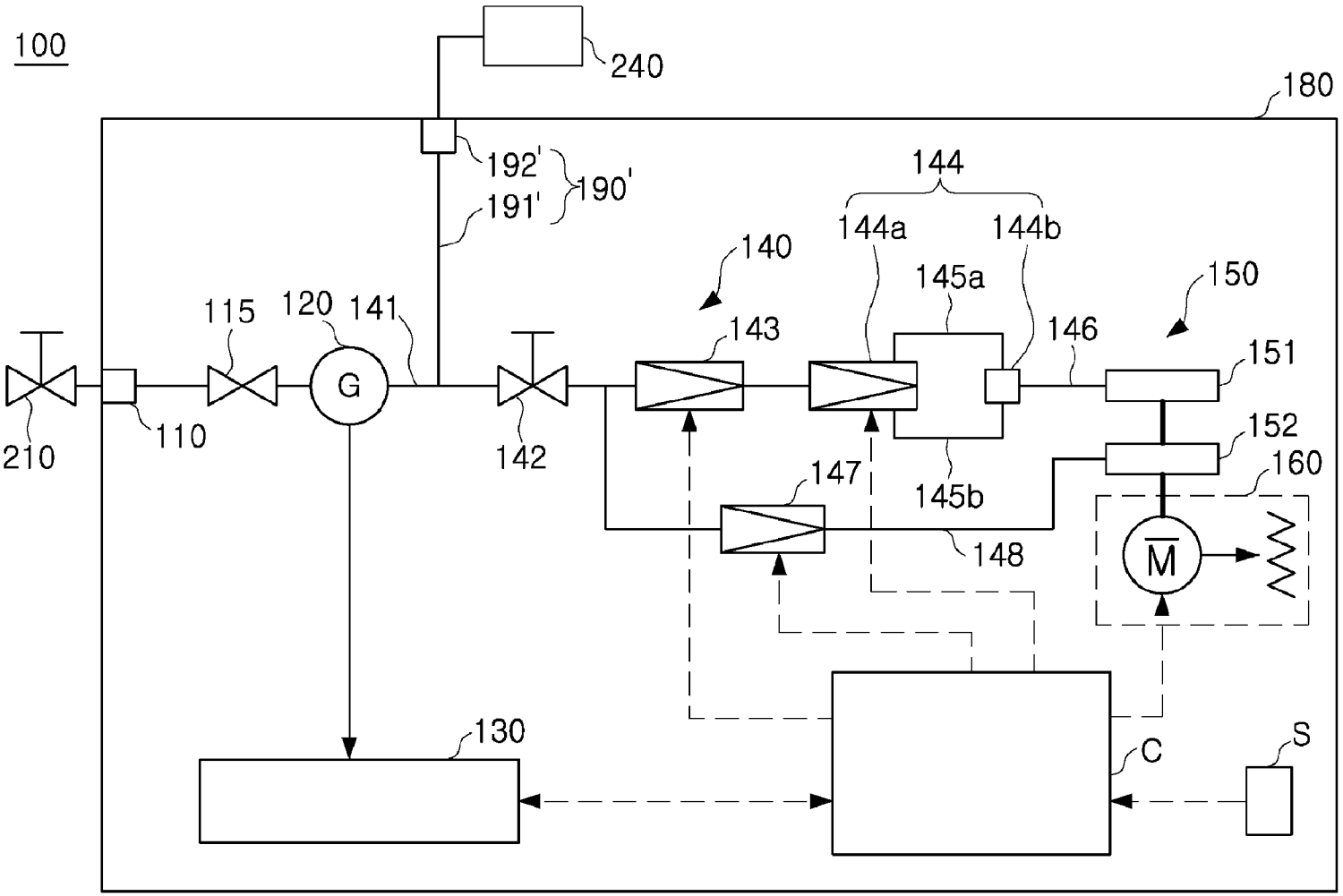

In this configuration, the only difference between the self-generating bidet 100 shown in FIG. 2 and the self-generating bidet 100 shown in FIG. 1 is that it further includes the tank passage part 190 installed to supply the water passing through the generator 120 to the water tank 230 and the only difference between the self-generating bidet 100 shown in FIG. 3 and the self-generating bidet 100 shown in FIG. 1 is that it further includes the water flushing passage part 190' installed to supply the water passing through the generator 120 to the bowl 240 of the toilet stool. Therefore, the self-generating bidets 100 shown in FIGS. 1 through 3 will be described together.

The water inlet 110 is supplied with water from a water supplying part 210 installed outside a bidet housing 180, similar to a water pipe or a pipe connected to a water pipe, wherein the water inlet 110 includes a connecting port to connect to the water pipe, and so on.

The water introduced into the water inlet 110 is introduced into the generator 120 to generate power. As an example, the generator 120 used in the present invention includes an impeller (hydraulic turbine) that is rotated when water flows into the generator 120, thereby making it possible to generate power. Further, the charging unit 130 is electrically connected to the generator 120 to store electricity generated from the generator 120 and electricity charged in the charging unit 130 is used to operate the bidet, i.e., a nozzle driver 160, various valves 143, 144, and 147, a sensing sensor S, and so on, of the bidet. As described above, a configuration of the generator 120 that generates power according to the flow of fluid and the charging unit 130 that charges electricity generated from the generator 120 are already known in various forms and therefore, a detailed description thereof will be omitted.

Meanwhile, the water passing through the generator 120 is supplied to the nozzle part 150 through the nozzle passage part 140. In this case, the nozzle passage part 140 may be provided various valves 143, 144, and 147 in order to supply or interrupt water to or from the nozzle part 150. The detailed configuration of the nozzle passage part 140 is not, however, limited to the examples shown in FIGS. 1 through 3.

Further, the nozzle part 150 may be configured to include not only an injection nozzle 151 for washing a human anus and/or a female pudendum, but may be configured to include a cleaning nozzle 152 that injects water to the upper surface of the injection nozzle 151 in order to wash the outer surface (in particular, the upper surface of the injection nozzle) of the injection nozzle 151.

As shown in FIGS. 1 through 3, the nozzle passage part 140 may include an injection nozzle passage 146 that supplies water to the injection nozzle 151 and the cleaning nozzle passage 148 that supplies water to a cleaning nozzle 152. The injection nozzle passage 146 may be provided with a first opening and closing valve 143 that opens and closes the injection nozzle passage 146 and may be installed with a flux control valve 144 to control the flux of water passing through the first opening and closing valve 143. The cleaning nozzle passage 148 may be provided with the second opening and closing valve 147 that opens and closes the cleaning nozzle passage 148.

In this configuration, it is preferable that the first opening and closing valve 143 and the second opening and closing valve 147 is constituted by a latch valve that is turned-on/off by electrical signals, thereby minimizing power consumption. The configuration of the latch valve having various forms and structures is already known and therefore, a detailed description thereof will be described.

Further, the flux control valve 144 may also be constituted by the latch valve that can control flux by being turned-on/off by electrical signals. As shown in FIGS. 1 through 3, the flux control valve 144 may include a body 144*a* that includes a single water introducing passage into which water is introduced and a plurality of water discharging passages 145*a* and 145*b* selectively opened to control flux and a combined water discharging hole 144*b* at which the plurality of water discharging passages 145*a* and 145*b* are combined.

Described in detail, as shown in FIG. 6 by way of example, the flux control valve 144 may be constituted by the latch valve that includes a water introducing passage 310 connected to a nozzle passage 141 and introduced with the water passing through the generator 120, a first passage 145*a* always opened to discharge water, and a second passage 145*b* opened by applied power.

In the flux control valve 144, a coil is wound on a solenoid SL disposed in an upper housing 327, a plunger 322 and an iron core 329 are disposed in the solenoid 322, a permanent magnet M is disposed on the previous portion of the iron core 329, and a spring 325 is disposed on the latter portion of the iron core 329 to push the plunger 322 to a water discharging hole 314.

A lower housing 328 may be provided with a water introducing passage 310 that is connected to the nozzle passage 141 and introduced with the water passing through the generator 120 and a second passage 145*b* that discharges the water passing through a space part 330 The ends of the water introducing passage 310 and the second passage 145*b* include a diaphragm 320 made of a rubber material having elasticity and a support 321 made of a plastic material that is inserted into the diaphragm 320 and provided with a water introducing hole 311 and a water discharging hole 314. In addition, the water introducing passage 310 is in communication with the space part 330 through the water introducing hole 311 and the second passage 145*b* is in communication with the space part 330 through the water discharging hole 314.

The space part 330 between the support 321 and the upper housing 327 is connected to the first passage 145*a* and the spring serving as a stopper 332 is mounted on the upper surface of the support 321. The stopper 332 has a radius larger than that of the plunger 322 such that it contacts the lower surface of the upper housing 327 when the support 321 rises together with the diaphragm 320, thereby limiting the rising position of the support 321 and the diaphragm 320.

Referring to FIG. 6, in the flux control valve 144 according to the exemplary embodiment of the present invention, since the water introducing passage 310 is in communication with the first passage 145*a* through the space part 330, even when the plunger 322 falls and is disposed at a turn-off position stopping the water discharging hole 314, the first opening and closing valve 143 is turned-on such that water can be discharged through the first passage 145*a* when water is introduced into the water introducing passage 310. Further, when the flux control valve 144 is turned-on, the plunger 322 rises to open the water discharging hole 314, such that the water introduced through the water introducing hole 311 is further discharged to the second passage 145*b* through the water discharging hole 314. Therefore, the water discharged from the first passage 145*a* and the second passage 145*b* is discharged through the combined water discharging hole 144*b* shown in FIGS. 1 and 2 and then, is supplied to the injection nozzle 151. Therefore, when the flux control valve 144, in a turned-on state, compares with that in a turned-off state, it can move flux larger than flux flowing through the second passage 145*b*.

As described above, if the latch valve as the first opening and closing valve 143 and the latch valve as the flux control valve 144 are used, only the first opening and closing valve 143 is opened when the injection nozzle 151 requires the low injection water-pressure (low flux) and the flux control valve 144 is further opened in the state in which the first opening and closing valve 143 is opened when the injection nozzle 151 requires the high water-pressure (high flux) injection. Therefore, the injection water pressure may be implemented at a multi-stage by simply turning-on/off the flux control valve 144, thereby making it possible to maximize savings in power consumption.

Meanwhile, the nozzle passage part 140 may be provided with a passive valve 142 to forcibly interrupt the passage when it controls the opening and closing rate of the valve to control the amount of introduced water or when abnormality occurs in parts configuring passages or replacement of parts are needed, and so on. The passive valve 142 is maintained in an opened state at normal times.

The injection nozzle 151 may include two nozzles, that is, a bidet nozzle to perform a bidet function for washing a female pudendum and a anus-washing nozzle to perform a anus-washing function for washing a human anus. However, the injection nozzle 151 may be configured of a single nozzle.

In addition, the nozzle part 150 may include the nozzle driver 160 that moves the injection nozzle 151 forwards and backwards. In this case, the nozzle driver 160 uses a DC motor, thereby making it possible to save power consumption as compared to the case of using a stepping motor.

In detail, the efficiency of the DC motor is about 75% to 80%. On the other hand, since the stepping motor uses current having several phases to precisely control a position, the current using efficiency of the stepping motor is about 50 to 60%, a 20 to 25% reduction in efficiency as compared to the DC motor. As in the exemplary embodiment of the present invention, the case of using the DC motor is more excellent in power consumption than the case of using the stepping motor. As a result, the DC motor is appropriate for the self-generating bidet. As the DC motor, a brush DC motor or a brushless DC motor (BLDC motor) may be used.

In addition, the movement of the injection nozzle 151 by the driving of the nozzle driver 160 can be controlled by using a variable resistor connected to the DC motor. A technology of controlling the rotational amount of the DC motor by the variable resistor is already known and a detailed description thereof will therefore be omitted.

Meanwhile, when only a single injection nozzle 151 is provided in the nozzle part 150, the driving of the nozzle part 160 is controlled to make the moving distance of the injection nozzle 151 different, thereby making it possible to implement the anus-washing function and the bidet function through the single injection nozzle 151. As described above, in the case in which the nozzle part 150 includes only a single injection nozzle 151, the configuration of the nozzle part 150 is simplified as compared to the case in which the nozzle part 150 includes two injection nozzles 151. Further, since the nozzle part 150 moves only a single injection nozzle 151, it is easy to control the nozzle driver 160. In other words, when the nozzle part 150 includes two injection nozzles 151, a complex gear structure is needed to move only one of two injection nozzles 151 as the single nozzle driver (motor) 160. However, when the nozzle part 150 uses only the single injection nozzle 151, a structure to drive the injection nozzle 151 is simplified, such that it is easy to control the nozzle driver 160. In addition, as described above, the case in which the DC motor is used as the nozzle driver 160 and the moving distance (i.e., rotational amount of DC motor) of the injection nozzle 151 is controlled by the variable resistor can save power consumption as compared to the case in which the stepping motor is used.

Meanwhile, the tank passage part 190 shown in FIG. 2 is configured so that it can be branched from the nozzle passage part 140 positioned at the latter portion of the generator 120 and can be connected to the water tank 230, thereby supplying the water passing through the generator 120 to the water tank 230 for washing a bowl of the toilet stool. As an example, the tank passage part 190 may include a tank passage 191 that is branched from the nozzle passage 141 and a connecting port 192 to connect the tank passage part 190 to the water tank 230. As described above, the tank passage part 190 is installed at the latter portion of the generator 120 so that water passes through the generator 120 while water is again supplied to the water tank 230 after water stored in the water tank 230 moves to the bowl of the toilet stool, thereby generating power.

Meanwhile, the water flushing passage part 190' shown in FIG. 3 is configured so that it can be branched from the nozzle passage part 140 positioned at the latter portion of the generator 120 and can be connected to the bowl 240, thereby supplying the water passing through the generator 120 to the bowl 240 of the toilet stool in which the washing water for washing the bowl 240 is filled. As an example, the water flushing passage part 190' may include a water flushing passage 191' that is branched from the nozzle passage 141 and a connecting port 192' to connect the flushing passage part 190' to the bowl 240. As described above, the water flushing passage part 190' is installed at the latter portion of the generator 120 so that water passes through the generator 120 when water is supplied to the bowl 240 to perform water flushing before or after the user uses the toilet stool, thereby generating power.

As described above, since the generator 120 generates power while discharging water through the nozzle part 150, the self-generating bidet 100 shown in FIG. 1 can also be installed at the toilet stool lacking the water tank 230. In particular, when the bidet is used, power generation is performed by water injected through the injection nozzle 151 or water discharged through the cleaning nozzle 152 for cleaning the nozzle and when generating capacity is insufficient or the voltage of the charging unit 130 is low, a large amount of water is discharged through the nozzle part 150, for example, the cleaning nozzle 152, for a sufficient period of time (for example, discharging water in an amount of about 1 liter per a minute for 1 to 2 minutes), thereby making it possible to generate the sufficient amount of power.

In addition, the self-generating bidet 100 shown in FIG. 2 generates power by using the water injected through the injection nozzle 151 or the water discharged through the cleaning nozzle 152 for cleaning the injection nozzle as well as by using the water supplied to the water tank 230 when the bidet is used, thereby making it possible to generate the sufficient amount of power. In addition, when the voltage of the charging unit 130 is low, the self-generating bidet 100 generates power by using a large amount of water that is forcibly discharged through the nozzle part 150, for example, the cleaning nozzle 152, such that it can generate power by using various methods and supplement the insufficient amount of electricity.

In addition, when the self-generating bidet 100 shown in FIG. 3 is used, it generates power by using the water injected through the injection nozzle 151 or the water discharged through the cleaning nozzle 152 for cleaning the injection nozzle 151 as well as by using the water supplied to the bowl 240, thereby making it possible to generate the sufficient amount of power. In addition, when the voltage of the charging unit 130 is low, the self-generating bidet 100 generates power by using a large amount of water that is forcibly discharged through the nozzle part 150, for example, the cleaning nozzle 152, such that it can generate power by using various methods and supplement the insufficient electricity.

As described above, the self-generating bidet 100 according to the exemplary embodiment of the present invention does not generate power by using only the water supplied to the water tank 230 or the bowl 240 of the toilet stool, but generates power by using the water supplied to the nozzle part 150 when the self-generating bidet 100 is used and by using the water forcibly discharged to the nozzle part 150 if power generation is needed, thereby making it possible to increase the generating capacity and maintain sufficient voltage of the charging part at all times.

The controller C controls the opening and closing of various valves 143, 144, and 147 installed at the nozzle passage part 140 so that the water is discharged through the nozzle part 150 when the voltage of the charging unit 130 is lower than the predetermined reference voltage, thereby driving the generator 120. The reference voltage may be set to an appropriate value in consideration of power necessary to operate various functions of the bidet.

If the capacity of power sufficient to use the bidet function and/or the anus-washing function is not secured after a user's bowel movement, the charging unit 130 should be charged. To this end, the controller C determines whether the voltage charged in the charging unit 130 is higher than the predetermined reference voltage. If it is determined that the voltage of the charging unit 130 is lower than the reference voltage, the controller C performs a control to generate power through the nozzle part 150. In detail, the controller C opens the passage of the nozzle passage part 140 to discharge water to the bowl of the toilet stool, such that the generator 120 generates power. In other words, since the generator 120 generates power only when fluid flows thereinto, in the case of the present invention, the controller C automatically opens the nozzle passage part 140 so that the generator 120 generates power when the voltage of the charging unit 130 is not sufficient, such that water flows from the nozzle part 150 to the bowl of the toilet stool.

As described above, the nozzle part 150 may include the injection nozzle 151 for washing a human anus and/or a female pudendum. The controller C controls the opening and closing of the first opening and closing valve 143 installed at the nozzle driver 160 and the nozzle passage part 140 so that the injection is performed in the state in which the injection nozzle 151 does not extend to the human body, that is, is not exposed to the outside of the bidet housing 180, thereby making it possible to prevent water from being directly injected to the human body. In addition, even though the injection nozzle 151 is not exposed to the outside of the bidet housing 180, it is possible to mount a separate cover on the upper side of the injection nozzle 151 in order to prevent water from splashing onto a human body or from penetrating into the bidet housing 180.

In addition, when the nozzle part 150 includes both the injection nozzle 151 and the cleaning nozzle 152, since the injection direction of water from the cleaning nozzle 152 is a down direction, water is discharged through the cleaning nozzle 152 such that power-generation is performed. In this case, the controller C opens a second opening and closing valve 147 so that water flows through a cleaning nozzle passage 148, thereby enabling the generator 120 to generate power.

In other words, the case in which water is injected through the cleaning nozzle 152 can minimize a phenomenon of splashing water onto the user as compared to the case in which water is discharged through the injection nozzle 151, thereby generating power while minimizing the inconvenience of user. In addition, when water is discharged through the cleaning nozzle 152, the water splashing is minimized, such that it is possible to discharge a large amount of water and additionally, to wash the injection nozzle 151.

Unlike the foregoing, the controller C controls the opening and closing of various valves 143, 144, and 147 installed at the nozzle passage part 140 so that the water is discharged through the nozzle part 150 when it meets the predetermined conditions, thereby making it possible to drive the generator 120. For example, the controller C senses the frequency of the bidet used by the user using a sensing sensor S, or the like, such that the generator 120 can generate power. When the user does not use the bidet for a long period of time, it is possible to generate power from the generator 120 after a predetermined time elapses so that the charging unit 130 is not discharged.

Meanwhile, the self-generating bidet 100 according to the exemplary embodiment of the present invention may include the sensing sensor S that senses whether the user wishes to use the bidet. In this case, the sensing sensor S may be used a sensor such as a seat sensing sensor that senses whether the user is seated on a bidet seat to generate a seating signal, an approaching sensing sensor that senses whether the user has approached the bidet within a predetermined distance, or a receiver receiving an operating signal transmitted through a remote controller by the user.

In this case, the seat sensing sensor may be used a sensor such as a capacitance sensor that measures the electrical change according to the seating of the user, or a tactile switch such as a micro switch, performing switching when the user is seated on the bidet seat or presses the switch or the like. That is, the sort, sensing scheme, and installation position of the seat sensing sensor are not specifically limited if the seat sensing sensor can sense the seating of the user.

In addition, as the approaching sensing sensor, various known sensors, such as an infrared sensor, or the like, may be used to sense whether the user has approached the bidet within a predetermined distance.

If the sensing sensor S senses that user wishes to use the bidet (for example, the user is seated on the bidet seat, the user has approached the bidet, the user applies the operating signal to the sensor through the remote controller, or the like), the controller C supplies power to various electronic devices, for example, various valves 143, 144, and 147, the nozzle driver 160, a display (not shown), or the like, from the charging unit 130. To the contrary, if the sensing sensor S senses that the user terminates the use of the bidet (for example, the user rises from the bidet seat, the user is away from the bidet seat, the user applies the ending signal through the remote controller, or the like), the controller C interrupts the supply of power from the charging unit 130 after the predetermined standby time elapses, thereby making it possible to minimize power consumption when the user does not use the bidet.

In other words, when the predetermined time elapses after the user terminates the use of the bidet, such as the case in which the user rises from the bidet seat, or the like, the controller C interrupts the supply of power to various electronic devices from the charging unit 130, thereby making it possible to minimize power consumption. In this case, in order to minimize power consumption after the user terminates the use of the bidet, it is preferable to completely interrupt the supply of power to the electronic parts from the charging unit 130. As described below, however, as in the case in which the user is seated on the bidet seat, the user has approached the bidet, or the user uses the remote controller, or the like, it is preferable to minimally maintain power to be supplied to the sensing sensor S in order for the sensing sensor S to sense that the user wishes to use the bidet.

Meanwhile, if the sensing sensor S senses that the user wishes to use the bidet, such as the case in which the user is seated on the bidet seat, the user has approached the bidet, or the like, it is preferable that the bidet automatically initiates the usable state. To this end, if the sensing sensor S senses that the user wishes to use the bidet, it is preferable that the controller C be configured to supply power to various electric parts from the changing unit 130.

In this case, it is preferable that the sensing sensor S includes the tactile sensor that is pressed and mechanically switched when the user is seated on the bidet seat. In other words, if the tactile switch, such as a micro switch, or the like, that is switched by the pressing of the user is used as the sensing sensor S, after the user rises from the bidet seat, power from the charging unit 130 can be completely interrupted and the switching is made as soon as the user is again seated on the bidet seat in order to use the bidet, the supply of power to various electronic parts from the charging unit 130 may be resumed.

In order for the generator 120 to maximally generate power, the pressure or flux loss of the water supplied to the water tank 230 should be minimized. However, when the water pressure of the water supplying part 210 is applied to the components of the nozzle passage part 140 as it is, the components may be out of order or the lifetime thereof may be shortened.

Therefore, in order to relatively reduce the pressure of water supplied to the nozzle passage part 140 while maintaining the pressure of water supplied to the tank passage part 190 at a high-pressure state, it is preferable that a diameter of the tank passage 191 included in the tank passage part 190 is larger than that of the nozzle passage 141 included in the nozzle passage part 140.

In this case, it is preferable that the ratio of the diameter of the nozzle passage 141 to the diameter of the tank passage 191 is 1:1.2 to 5. If the diameter of the tank passage 191 is 1.2 times smaller than that of the nozzle passage 141, the water pressure introduced into the nozzle passage 141 is high, such that the components installed at the nozzle passage part 140 may be damaged or the lifetime thereof may be degraded. On the other hand, if the diameter of the tank passage 191 exceeds the diameter of the nozzle passage 141 by 5 times, the diameter of the nozzle passage 141 is too small as compared to the diameter of the tank passage 191, such that the injection of the injection nozzle 151 cannot be properly implemented while the bidet is used and the flux of water discharged through the nozzle part 150 during power generation is small, such that sufficient power-generation cannot be performed.

For the reason as described in the tank passage part 190, in order to relatively reduce the pressure of water supplied to the nozzle passage part 140 while maintaining the pressure of water supplied to the water flushing passage part 190' at a high-pressure state, it is preferable that the diameter of the water flushing passage 191' included in the water flushing passage part 190' is larger than that of the nozzle passage 141 included in the nozzle passage part 140.

The self-generating bidet 100 according to the exemplary embodiment of the present invention is excellent in appearance since the pipes or the components for power generation are not exposed to the outside by integrally installing the generator 120, the charging unit 130, the nozzle part 150, and the nozzle passage part 140 shown in FIG. 1 in the bidet housing 180. Further, since the configuration of power generation is completed only by connecting the water supplying part 210 to the water inlet 110, it is very easy to install the self-generating bidet. In addition, as shown in FIG. 2, when the self-generating bidet includes the tank passage part 190, the components shown in FIG. 1 and the tank passage part 190 are installed in the bidet housing 180, such that the appearance of the bidet can be improved and the bidet can be easily installed. In addition, as shown in FIG. 3, when the self-generating bidet includes the water flushing passage part 190', the components shown in FIG. 1 and the water flushing passage part 190' are installed in the bidet housing 180, such that the appearance of the bidet can be improved and the bidet can be easily installed.

Meanwhile, when the high-pressure water is directly introduced into the generator 120, a considerable amount of noise occurs due to the rapid rotation of the impeller. Therefore, the water pressure should be properly reduced in order to secure the generating capacity while minimizing the noise due to the self-generation at the high-pressure area and prevent the components installed at the nozzle passage part 140 from being damaged. To this end, it is preferable to install a pressure reducing valve 115, which reduces water pressure to a predetermined level or less, between the water inlet 110 and the generator 120.

Next, a self-generating bidet according to another exemplary embodiment will be described with reference to FIGS. 4 and 5.

Similar to the self-generating bidet shown in FIGS. 1 through 3, the self-generating bidet 100 shown in FIGS. 4 and 5 is configured to include the water inlet 110 into which water is introduced, the generator 120 that generates power by the water introduced into the water inlet 110, a charging unit 130 that stores electricity generated from the generator 120, the nozzle part 150 that is configured to inject the water introduced into the water inlet 110 to a human body, and the nozzle passage part 140 provided between the generator 120 and the nozzle part 150 to supply the water passing through the generator 120 to the nozzle part 150. Further, the self-generating bidet 100 shown in FIGS. 4 and 5 may be configured to further include the tank passage part 190 provided between the generator 120 and the water tank 230 to supply the water passing through the generator 120 to the water tank 230 for flushing the bowl of the toilet stool and the controller C that opens the passage of the nozzle passage part 140 to drive the generator 120 so that water is discharged through the nozzle part 150 when the voltage of the charging unit 130 is lower than the reference voltage Further, although not separately shown in FIGS. 4 and 5, the self-generating bidet 100 may be configured to further include the water flushing passage part 190' provided between the generator 120 and the bowl 240 to supply the water passing through the generator 120 to the bowl 240 of the toilet stool, instead of the tank passage part 190 and the controller C that opens the passage of the nozzle passage part 140 to drive the generator 120 so that water is discharged through the nozzle part 150 when the voltage of the charging unit 130 is lower than the reference voltage, as shown in FIG. 3.

However, when the self-generating bidet 100 shown in FIGS. 4 and 5 compares with the self-generating bidet shown in FIGS. 1 through 3, there is a difference in that it includes a hot water inlet 170 into which hot water is introduced and a mixing valve 141*a* installed at the latter portion of the generator 120 to mix the water introduced from the water inlet 110 with the hot water introduced from the hot water inlet 170, thereby supplying the water passing through the mixing valve 141*a* to the nozzle part 150 In order to avoid unnecessarily repeated description, a detailed description of the same or similar components will be omitted. Therefore, the hot water inlet 170 and the mixing valve 141*a* and only the components related to the hot water inlet 170 and the mixing valve 141*a* will be described.

As shown in FIGS. 4 and 5, the hot water inlet 170 is configured so that it is connected to a hot water supplying part 220, such as a boiler pipe, or the like, that can generate or supply hot water by a connecting port to supply the hot water to the nozzle passage part 140 In this case, the hot water passage 171 is combined with the nozzle passage 141 at the latter portion of the generator 120, thereby making it possible to prevent the magnet of the generator 120 due to the hot water introduced into the hot water inlet 170 from being damaged.

Further, the hot water passing through the hot water passage 171 is introduced into the mixing valve 141*a* so that it is mixed with the water introduced from the water inlet 110. In this case, the mixing valve 141*a* may be configured to passively or automatically control the mixing degree of the hot water and water (cold water) in order to control the temperature of water injected through the injection nozzle 151.

As described above, when the self-generating bidet includes the hot water inlet 170, it can control the temperature of water injected through the injection nozzle 151. In particular, the mixing valve 141*a* is installed at the latter portion of the generator 120 to prevent the magnet of the generator 120 from being damaged due to the hot water, thereby making it possible to smoothly use the generator 120.

Meanwhile, when the self-generation is performed a high-pressure (for example, water pressure of 5 kgf or more) area, the generating capacity can be sufficiently large, but if high-pressure water is introduced into the generator 120, a considerable amount of noise occurs due to the rapid rotation of the impeller. Therefore, the water pressure should be properly reduced to secure the generating capacity while minimizing noise due to the self-generation in the high-pressure area. To this end, as shown in FIG. 4, it is preferable to install the pressure reducing valve 115, which reduces water pressure to a predetermined level (for example, 3 to 4 kgf) or less, between the water inlet 110 and the generator 120.

On the other hand, since the noise of the generator 120 due to the water pressure is not large in the low water pressure area, there may be no need to install the pressure reducing value. However, the components installed at the nozzle passage part 140 may be damaged due to the fluctuation in water pressure (water hammering phenomenon), such that it is possible to install the pressure reducing valve 115 at the nozzle passage part 140 positioned at the latter portion of the generator 120 as shown in FIG. 5. As is also shown in FIG. 5, it is possible to install a check valve 111 at the water inlet 110 in order to prevent the water introduced into the water inlet 110 from reflowing.

Next, a controlling method S100 applicable to the self-generating bidet 100 according to an exemplary embodiment of the present invention will be described with reference to the configuration of the self-generating bidet 100 shown in FIGS. 1 through 5 and the flow charts of FIGS. 7 and 8.

First, the method S100 for controlling the self-generating bidet 100 according to the exemplary embodiment of the present invention relates to a method for controlling the self-generating bidet 100 that includes the generator 120, the charging unit 130, the nozzle part 150, and the nozzle passage part 140 as shown in FIG. 1 and generates power from the generator 120 using the water (hereinafter, in describing the controlling method, including a state where water and hot water are mixed as shown in FIG. 5 but simply referred to as 'water') flowing in the nozzle passage part 140, the self-generating bidet 100 that includes the generator 120, the charging unit 130, the nozzle part 150, the nozzle passage part 140, and the tank passage part 190 as shown in FIGS. 2, 4, and 5 and generates power from the generator 120 using the water flowing in the tank passage part 190 and the nozzle passage part 140, or the self-generating bidet 100 that includes the generator 120, the charging unit 130, the nozzle part 150, the nozzle passage part 140, and the water flushing passage part 190' as shown in FIG. 3 and generates power from the generator 120 using the water flowing in the water flushing passage part 190' and the nozzle passage part 140.

As shown in FIG. 7, the method S100 for controlling the self-generating bidet according to the exemplary embodiment of the present invention may include a step of sensing S110 whether the user wishes to use the bidet, a step of checking voltage S130 that performs power generation through the generator 120 if the voltage of the charging unit is lower than the reference voltage, and a step of using a bidet S150 that supplies and injects water to and from the nozzle part 150 according to the function selection of the user after the step of checking voltage S130.

The step of sensing the use of the bidet S110 senses whether the user is seated on the bidet seat (not shown), the user has approached the bidet, or the user applies the operating signal to the sensing sensor through the remote controller in order to use the bidet by using the sensing sensor S. As the sensing sensor S, a sensor that measures the electrical change according to the seating of the user similar to the capacitance sensor may be used, the tactile switch that is switched by being pressed when the user is seated on the bidet seat similar to the micro switch may be used, the infrared sensor sensing the approaching of the user may be used, the receiver (not shown) receiving transmitted from the remote controller by the user may be used, or the like. That is, the sort, sensing scheme, and installation position of the sensor are not specifically limited if the sensor is able to sense whether the user wishes to use the bidet.

As described above, if the sensing sensor S senses the user wishes to use the bidet, the voltage charged in the charging unit 130 is checked and when the voltage of the charging unit is insufficient, that is, the capacity of power enough to use the bidet function and/or the anus-washing function is not secured after a user's bowel movement, the step of checking voltage S130 that charges the charging unit 130 is performed.

In detail, if the step of checking voltage S130 senses whether the user wishes to use the bidet (the user is seated on the bidet seat, the user has approached the bidet, the user applies the operating signals through the remote controller, or the like), it determines whether the current voltage charged in the charging unit 130 is lower than the predetermined reference voltage. If it is determined that the voltage of the charging unit is lower than the reference voltage, the charging unit 130 is charged by electricity generated from the generator 120.

As shown in FIG. 8 as one example, the step of checking voltage S130 may include a step of measuring S131 the voltage charged in the charging unit 130, a step of determining S132 whether the voltage of the charging unit is higher than the predetermined reference voltage, and a step of generating power S133 that performs power generation if it is determined that the voltage of the charging unit is lower than the reference voltage.

In this case, the step of generating power S133 generates power by opening the passage of the nozzle passage part 140 to discharge water to the bowl of the toilet stool from the nozzle part 150. In other words, since the generator 120 generates power only when fluid flows thereinto, in the case of the present invention, the nozzle passage part 140 is automatically opened so that the generator 120 generates power when the voltage of the charging unit 130 is not sufficient, such that water flows from the nozzle part 150 to the bowl of the toilet stool.

The nozzle part 150 may include the injection nozzle 151 for washing a human anus and/or a female pudendum. At the step of generating power S133, the injection is performed in the state in which the injection nozzle 151 does not extend to a human body, thereby making it possible to prevent water from being directly injected to the human body.

Unlike the foregoing, when the nozzle part 150 includes both the injection nozzle 151 and the cleaning nozzle 152, since the injection direction of water from the cleaning nozzle 152 is a downward direction, the water is discharged through the cleaning nozzle 152 such that power-generation is performed. In other words, the case in which water is injected through the cleaning nozzle 152 can minimize a phenomenon of splashing water onto the user as compared to the case in which water is discharged through the injection nozzle 151, thereby making it possible to increase the discharged water amount and wash the injection nozzle 151.

The step of generating power S133 is continually performed until the voltage of the charging unit is larger than the reference voltage.

However, when the performance of the charging unit 130 is degraded or the charging unit is failure, or the like, the voltage charged in the charging unit 130 may not reach the reference voltage even though the step of generating power S133 is performed. In order to determine the abnormality of the charging unit 130, it is determined whether the step of generating power S133 exceeds the reference time (S136). If the voltage of the charging unit does not reach the reference voltage for the reference time, it is determined that the charging unit 130 is abnormal, which is displayed on a display (S137). Thereafter, the step of checking voltage ends (S138).

The step of checking voltage S130 may include a step of generating additional power S135 by additionally discharging water to the nozzle part 150 for the predetermined period of power generation without immediately ending the step of generating power S133 when the voltage of the charging unit that is being charged is larger than the reference voltage. Even though the user performs the bidet function or the anus-washing function several times, the nozzle part 150 can be stably operated by performing the step of generating the additional power. In particular, since there is no need to generate power each time the user is seated on the bidet seat by setting the voltage of the charging unit to be higher than the reference voltage, user inconvenience can be minimized. Even though the period of power generation can be varied according to the water pressure or the performance of the generator, it may be set so as to be sufficient to generate power even after the user has used the bidet several times.

Similar to the step of generating power (S133), the step of generating the additional power (S135) may be performed by injecting water from the injection nozzle 151. However, when the self-generating bidet includes the cleaning nozzle 152, it is more preferable to perform power generation by discharging water to the cleaning nozzle 152 in consideration of the minimization of the water splashing phenomenon, the maximization of the discharged water amount, the cleaning of the injection nozzle 151, or the like.

As shown in FIG. 8, after the step of checking voltage S130 of the charging unit 130 ends, the standby step S145 is performed until the user selects the functions. Thereafter, if the user selects the functions, the step of using the bidet S150 is performed.

The step of using the bidet S150 may include the step of performing the anus-washing function S151 to S154 washing the human anus by the selection of the user and/or a step of performing the bidet function S151', S152', S153, and S154 for washing a female pudendum, similar to the general bidet.

In other words, if the user selects the anus-washing function (S151), the nozzle for performing the anus-washing function extends to a position corresponding to the human body and injects water, such that the anus-washing function is performed (S152) and if the user presses a stop button (stopping key) or the injection time exceeds the predetermined time (S153), the injection of water ends and the nozzle for performing the anus-washing function is returned to the original position (S154).

Similar to the step of performing the anus-washing function, if the user selects the bidet function (S151'), the nozzle for performing the bidet function extends to a position corresponding to the human body and injects water, such that the bidet function is performed (S152') and if the user presses a stop button (stopping key) or the injection time exceeds the predetermined time (S153), the injection of water ends and the nozzle for performing the bidet function is returned to the original position (S154).

As described above, the step of using the bidet S150 may include the bidet nozzle and the anus-washing nozzle, that is, two nozzles performing each function as the injection nozzle in order to perform the bidet function and the anus-washing function. However, the configuration of the injection nozzle 151 is not limited thereto, a single injection nozzle 151 can execute the step of performing the anus-washing function S151 to S154 and the step of performing the bidet function S151', S152', S153, and S154. In other words, the nozzle part 150 includes only one injection nozzle 151 and can be configured to perform both the anus-washing function and the bidet function by controlling the moving distance of the injection nozzle 151 by driving the nozzle driver 160 moving forwards and backwards.

As described above, in the case in which the nozzle part 150 includes only a single injection nozzle 151, the configuration of the nozzle part 150 is simplified as compared to the case in which the nozzle part 150 includes two injection nozzles 151 as described in the self-generating bidet 100 shown in FIG. 1. Further, since the nozzle part 150 moves only a single injection nozzle 151, it is easy to control the nozzle driver 160.

Meanwhile, the step of performing the anus-washing function S152 and the step of performing the bidet function S152' may further include the step of selecting the flux that selects the injected flux or water pressure, similar to the general bidet. In this case, when the self-generating bidet 100 shown in FIG. 1 uses the latch valve including the first passage 145*a* always opened as the flux control valve 144 for controlling flux and the second passage 145*b* opened by the applied power as described with reference to FIG. 6, the flux can be controlled by simply turning-on/off the latch valve, thereby making it possible to maximize power consumption savings.

Meanwhile, the method S100 for controlling the self-generating bidet according to the exemplary embodiment of the present invention may further include cleaning the injection nozzle 151 (S140) by supplying water between the step of checking voltage (S130) and the step of using the bidet (S150) or between the step of sensing the use of the bidet (S110) and the step of using the bidet (S150) by the cleaning nozzle 152. As described above, when performing the step of cleaning the injection nozzle S140, the user washes the injection nozzle 151 prior to using the injection nozzle 151 to prevent water from being injected in the state in which the injection nozzle 151 is polluted. The water is discharged during the step of cleaning the injection nozzle such that power generation through the generator 120 can be additionally performed, thereby making it possible to increase the voltage of the charging unit 130.

Unlike the foregoing, although not specifically shown in FIG. 7, the method S100 for controlling the self-generating bidet according to the exemplary embodiment of the present invention may be configured to immediately perform the standby step S145 without being subjected to the step of cleaning the injection nozzle when previously performing the step of generating power S133 at the step of checking voltage. In other words, when power generation is performed through the cleaning nozzle 152 at the step of generating power S133, the cleaning of the injection nozzle 151 is previously performed, such that the step of cleaning the injection nozzle S140 may not be performed.

Further, the water is supplied to the cleaning nozzle 152 even after the step of using the bidet S150, such that the step of cleaning the injection nozzle S160 cleaning the injection nozzle 151 can be performed. As described above, when performing the step of cleaning the injection nozzle S160, it can prevent the injection nozzle 151 from maintaining in the state in which the injection nozzle 151 is polluted by cleaning pollutants remaining in the injection nozzle 151 after a user's bowl movement. The water is discharged during the cleaning of the injection nozzle 151, such that the additional power generation through the generator 120 can be performed, thereby making it possible to increase the voltage of the charging unit 130.

Further, the method S100 for controlling the self-generating bidet according to the exemplary embodiment of the present invention may further include a step of sensing whether a user has terminated the use of the bidet S170 such as the case in which the user rises from the bidet seat or the user is away from the bidet, or the like, by the sensing sensor S and a step of interrupting the supply of power S180 from the charging unit 130 when the predetermined standby time elapses after the step of sensing the termination of the use of the bidet.

Although not shown in detail, even in the case in which the user is away from the bidet seat without using the bidet function or the anus-washing function during the standby step S145, the step of sensing the termination of the use of the bidet S170 and the step of interrupting the supply of power S180 can be performed.

As described above, when the predetermined time elapses after the user terminates the use of the bidet (for example, when the user is away from the bidet seat, or the like), power consumption can be minimized by interrupting the supply of power to various electronic parts, for example, various valves 143, 144, and 147, the nozzle driver 160, the display (not shown), or the like, from the charging unit 130.

In this case, in order to minimize the consumed power after the user has terminated the use of the bidet, it is preferable to completely interrupt power to the electronic parts from the charging unit 130. However, as in the case in which the user is seated on the bidet seat, the user has approached the bidet, the user uses the remote controller, or the like, in order to sense whether the user wishes to use the bidet through the sensing sensor S, some components of the sensing sensor S and the controller C receiving signals from the sensing sensor C and again supplying power to various electronic parts can be configured to minimally maintain the supply of power from the charging unit 130.

As described above, when the supply of power is interrupted, in order to confirm the voltage of the charging unit necessary to use the bidet simultaneously with using the bidet when sensing whether the user wishes to use the bidet at the step of sensing the use of the bidet S110, the step of supplying power 120 that resumes the supply of power to various electronic parts and the controller C from the charging unit 130 is performed.

In this case, as the sensing sensor S, the capacitance sensor, the infrared sensor, or the like, may be used. However, the supply of power from the charging unit 130 is completely interrupted after the user rises from the bidet seat. Thereafter, it is preferable that a tactile sensor such as a micro switch or the like is used to perform the automatic switching when the user is seated on the bidet seat or presses the switch for reusing the bidet. As described above, when the micro switch is used, the supply of power to various electronic parts and the controller C from the charging unit 130 at the step of interrupting the supply of power S180 may be completely interrupted. Further, when the switching is performed when the user is seated on the bidet seat, or the like, the supply of power from the charging unit 130 can be automatically resumed, such that power consumption can be prevented when he/she does not use the bidet.

Next, the method S100 for controlling the self-generating bidet 100 will be described with reference to the configuration of the self-generating bidet 100 shown in FIGS. 1 through 5 and flow charts of FIGS. 9 and 10.

Similar to the method S100 for controlling the self-generating bidet, a method S100 for controlling the self-generating bidet 100 shown in FIG. 9 relates to a method for controlling the self-generating bidet 100 that includes the generator 120, the charging unit 130, the nozzle part 150, and the nozzle passage part 140 as shown in FIG. 1 and generates power from the generator 120 using the water flowing in the nozzle passage part 140, the self-generating bidet 100 that includes the generator 120, the charging unit 130, the nozzle part 150, the nozzle passage part 140, and the tank passage part 190 as shown in FIGS. 2, 4, and 5 and generates power from the generator 120 using the water flowing in the tank passage part 190 and the nozzle passage part 140, or the self-generating bidet 100 that includes the generator 120, the charging unit 130, the nozzle part 150, the nozzle passage part 140, and the water flushing passage part 190' as shown in FIG. 3 and generates power from the generator 120 using the water flowing in the water flushing passage part 190' and the nozzle passage part 140.

In detail, similar to the method S100 for controlling the self-generating bidet shown in FIG. 7, the method S100 for controlling the self-generating bidet shown in FIG. 9 is configured to include: the step of using the bidet (S110) that senses whether the user wishes to use the bidet; if it is determined that the user wishes to use the bidet, the step of checking voltage (S130) that determines whether the voltage charged in the charging unit 130 is lower than the predetermined reference voltage, and if so, performs power generation through the generator 120, and charges the charging unit 130; the step of using the bidet (S150) that supplies and injects water to and from the nozzle part 150; and the step of determining (S190) the self-generating enable state or not by comparing the additional generating capacity generated from the generator 120 with the predetermined reference value.

In other words, the method S100 for controlling the self-generating bidet shown in FIG. 9 is the same or similar to the method S100 for controlling the self-generating bidet shown in FIG. 7 except that it further includes the step of determining the self-generating enable state or lack thereof, and therefore, the same or a similar description thereof will be omitted in order to avoid an unnecessarily repeated description. As a result, the differences therebetween will be described.

The step of determining the self-generating enable state or lack thereof can be performed (S190) is a step of determining whether the self-generating bidet 100 is installed in an area (for example, an area having a high water pressure) in which the self-generation can be performed or whether the self-generation cannot be efficiently performed due to the fluctuation of water pressure, the degradation in performance of the charging unit 130, or the like.

In the case of the self-generating bidet 100 that performs power generation through the flux flowing through the passage in the bidet, since the power generated is very small, there is a need to minimize the amount of electricity used in the bidet. Further, the generating capacity through the generator 120 should not be larger than the amount of electricity used by the use of the bidet.

Therefore, in order to determine whether the generating capacity is smaller than the used amount of electricity, the step of determining the self-generation enable state or not S190 can be performed after the step of sensing the use of the bidet S110.

The step of determining the self-generating enable or not S190 can be performed as one process in any step between the step of using the bidet S110 and the step of interrupting the supply of power S180. When the step of determining whether the self-generation can be performed S190 ends, it returns to an original step S195 and then, the following steps are performed.

As shown in FIG. 10, the step of determining the self-generating enable or not S190 may further a step of generating power S191 by introducing water into the generator, a step of comparing a frequency S192 that compares a signal generated by the rotation of the impeller during power generation through the generator 120, that is, the frequency of the generator with the predetermined reference frequency; if it is determined that the frequency of the generator is larger than the reference frequency, a step of determining S193 as the self-generating enable state since the generating capacity is sufficient and if not, a step of determining and displaying S194 that there is a problem in the self-generation In this case, the reference frequency may be set in consideration of various factors, such as the used amount of electricity to be expected when using the general bidet, the generating capacity to be generated per 1 rotation of the impeller, or the like.

In other words, the step of determining the self-generating enable state or lack thereof S190 according to the exemplary embodiment of the present invention determines whether the water pressure is larger enough to perform the self-generation by supplying water to the generator 120 to drive the generator 120 and comparing the frequency of the generator generated according to the rotational speed of the impeller by the water pressure with the predetermined reference frequency.

In this case, the step of generating power S191 introduces water to the generator 120 and then discharges water through the nozzle part 150, such that power generation is performed. Therefore, it is preferable to use the step of supplying water to the generator 120 in the steps shown in FIG. 9. For example, the step of generating power S191 may use the step of cleaning the nozzle S140 shown by "B" in FIG. 9 and may use the step of cleaning the nozzle S160 as shown by "D" in FIG. 9. However, the step of generating power S191 is not limited thereto. As shown by "A" in FIG. 9, the step of generating power S191 can be performed as a separate step after the step of checking voltage S130. As shown by "C" in FIG. 9, the step of generating power S191 can be performed as a separate step after the step of using the bidet S150.

Meanwhile, since the step of determining the self-generating enable state or lack thereof S190 is to determine whether the water pressure is appropriate for the use of the self-generating bide, it is can be performed only once between the step of sensing the use of the bidet S110 and the step of interrupting the supply of power S180. Further, the step of determining the self-generating enable state or lack thereof S190 is not necessarily performed each time the bidet is used. Therefore, the step of determining the self-generating enable state or lack thereof S190 may be performed in various forms, such as when the bidet is initially installed, when the user is passively installed, when the bidet is performed by a predetermined time, or the like.

As described above, the exemplary embodiment of the present invention performs the step of determining the self-generating enable state or nor S190 to determine whether the generating capacity is sufficient to used the bidet and, if it is determined that the generating capacity is insufficient, it displays this state to confirm whether the self-generating bidet 100 is stably used.

As set forth above, according to exemplary embodiments of the present invention, a self-generating bidet that can be used stably by generating power by discharging a sufficient amount of water through a nozzle part even when a voltage charged in a charging unit is insufficient to use the bidet.

In a self-generating bidet according to exemplary embodiments of the present invention, sufficient power is generated by using water supplied to a water tank or a bowl of a toilet stool, and additional power generation is performed by using water injected or discharged through a nozzle part while the bidet is used. Further, when voltage charged in a charging unit is insufficient, the water is forcibly discharged to the nozzle part to thereby generate power. Therefore, generating capacity can be maximized and sufficient power to drive various electric components of the bidet can be secured.

In a self-generating bidet according to exemplary embodiments of the present invention, a generator and a charging unit are disposed within a bidet housing, and a water inlet and a tank passage part/a water flushing passage part are respectively connected to a water supplying part and a water tank/a bowl of a toilet stool, whereby the wiring is not exposed to the outside and the installation thereof can be facilitated.

Further, a self-generating bidet according to exemplary embodiments of the present invention completely interrupts the supply of power to various electric components from the changing unit after a user finishes the use of the bidet or uses only the minimum amount of power required to resume the supply of power through the sensing of a sensing sensor, thereby minimizing the consumption of standby power and thus, minimizing power consumption. Further, in the case of using a seat sensor including a tactile switch that is switched by being pressed when the user is seated on a bidet seat, the supply of power is resumed as soon as the tactile switch is switched when the user is seated on the bidet seat in a state in which the supply of power from the charging unit is completely interrupted, thereby allowing the user to stably use the bidet.

According to exemplary embodiments of the present invention, a latch valve is used as a flux control valve, thereby controlling flux while minimizing power consumption. In addition, various valves are formed as a latch valve, such that power consumption can be minimized.

A self-generating bidet according to exemplary embodiments of the present invention can be used in a toilet stool having no water tank since power generation is performed by discharging the sufficient amount of water through a nozzle part. In addition, the self-generating bidet can be used even in a direct water type toilet stool having no water tank since power generation is performed by using water supplied to a bowl of a toilet stool through the water flushed by a user.

In a self-generating bidet according to exemplary embodiments of the present invention, a hot water passage is disposed at the rear portion of a generator, thereby preventing a magnet of the generator from being damaged due to hot water.

In addition, a pressure reducing valve is installed at the previous portion of the generator, thereby reducing noise generated from the generator in a high water pressure area. Further, in the case of a low water pressure area, a pressure reducing valve is installed at the latter portion of the generator, and thus the water pressure is directly transferred to the generator to thereby improve power generating efficiency and prevent components provided in a nozzle passage part from being damaged due to fluctuations in water pressure (a water hammering phenomenon).

According to exemplary embodiments of the present invention, it is possible to confirm whether a charging unit is abnormal or not by comparing a voltage charged in the charging unit during a reference time with a threshold voltage (reference voltage).

According to exemplary embodiments of the present invention, it is possible to confirm whether water pressure sufficient to use a self-generating bidet is maintained or not since it is determined whether the power of the bidet can be self-generated or not by comparing generating capacity generated from a generator with a reference value.

While the present invention has been shown and described in connection with the exemplary embodiments, it will be apparent to those skilled in the art that modifications and variations can be made without departing from the spirit and scope of the invention as defined by the appended claims.

What is claimed is:

1. A self-generating bidet, comprising:

a water inlet configured to receive water from a water source;

a generator positioned downstream of the water inlet, the generator being configured to receive water from the water inlet and generate electricity as the water flows through the generator;

a charging unit electrically connected to the generator, the charging unit being configured to store the electricity generated by the generator;

at least one nozzle disposed downstream of the generator; and a nozzle passage positioned between the generator and the at least one nozzle, the nozzle passage including at least one valve configured to control the flow of water to the at least one nozzle; and a controller communicatively coupled to the at least one valve, the controller being configured to open the valve such that water is directed from the generator to the at least one nozzle.

2. The self-generating bidet of claim 1, further comprising a water tank disposed downstream of the generator and a tank passage positioned between the generator and the water tank, the tank passage being configured to direct water passing through the generator to the water tank.

3. The self-generating bidet of claim 1, further comprising a toilet bowl positioned downstream of the generator and a water flushing passage positioned between the generator and the toilet bowl, the water flushing passage being configured to direct water passing through the generator to the toilet bowl.

4. The self-generating bidet of claim 1, wherein the controller is configured to open the at least one valve when a voltage of the charging unit is lower than a predetermined reference voltage.

5. The self-generating bidet of claim 4, wherein the at least one nozzle includes an injection nozzle and a cleaning nozzle, the controller being configured to open the at least one valve such that water is discharged through the cleaning nozzle when the voltage of the charging unit is lower than the predetermined reference voltage.

6. The self-generating bidet of claim 1, wherein the controller is configured to open the at least one valve when a predetermined condition is satisfied.

7. The self-generating bidet of claim 1, further comprising a sensor communicatively coupled to the controller, the sensor being configured to detect when use of the self-generating bidet is initiated and terminated, wherein the controller is configured to control the charging unit such that power is supplied from the charging unit when the sensor detects that use of the self-generating bidet has been initiated, the controller being further configured to control the charging unit such that the power supplied from the charging unit is interrupted when a predetermined standby time elapses after the sensor detects that use of the self-generating bidet has been terminated.

8. The self-generating bidet of claim 7, wherein the sensor includes a tactile switch configured to detect when a user is seated on a bidet seat of the self-generating bidet.

9. The self-generating bidet of claim 1, wherein the nozzle part includes an injection nozzle and a cleaning nozzle configured to clean the injection nozzle, and wherein the at least one valve comprises a first valve and a second valve, the first valve being configured to control the flow of water to the injection nozzle, the second valve being configured to control the flow of water to the cleaning nozzle.

10. The self-generating bidet of claim 9, wherein the first and second valves comprise latch valves.

11. The self-generating bidet of claim 9, wherein the nozzle passage further includes a flux control valve positioned downstream of the first valve so as to control a flux of the water supplied to the injection nozzle.

12. The self-generating bidet of claim 11, wherein the flux control valve comprises a latch valve, the flux control valve including a first passage configured to be in a continuously open state and a second passage configured to be electronically opened and closed.

13. The self-generating bidet of claim 1, wherein the at least one nozzle includes an injection nozzle and a nozzle driver configured to move the injection nozzle forwards and backwards, the controller being configured to control the operation of the nozzle driver such that a moving distance of the injection nozzle is variable.

14. The self-generating bidet of claim 2, wherein at least a portion of the tank passage defines a diameter that is larger than a diameter defined by at least a portion of the nozzle passage.

15. The self-generating bidet of claim 1, further comprising a bidet housing, wherein the generator, the charging unit, the at least one nozzle and the nozzle passage are housed within the bidet housing.

16. A self-generating bidet, comprising:

a water inlet configured to receive water from a water source;

a generator positioned downstream of the water inlet, the generator being configured to receive water from the water inlet and generate electricity as the water flows through the generator;

a charging unit electrically connected to the generator, the charging unit being configured to store the electricity generated by the generator;

a hot water inlet separate from the water inlet, the hot water inlet being configured to receive hot water from a hot water source;

a mixing valve positioned downstream of the generator, the mixing valve being configured to mix the water flowing through the generator with the hot water from the hot water inlet;

at least one nozzle disposed downstream of the mixing valve; and a nozzle passage positioned between the mixing valve and the at least one nozzle, the nozzle passage being configured to direct the mixed water from the mixing valve to the at least one nozzle.

17. The self-generating bidet of claim 16, further comprising a pressure reducing valve positioned between the water inlet and the generator.

18. The self-generating bidet of claim 16, further comprising a pressure reducing valve positioned downstream of the generator.

19. The self-generating bidet of claim 16, further comprising a valve configured to control the flow of water through the nozzle passage and a controller communicatively coupled to the valve, the controller being configured to open the valve when a voltage of the charging unit is lower than a predetermined reference voltage.

20. The self-generating bidet of claim 19, wherein the at least one nozzle includes an injection nozzle and a cleaning nozzle, the controller being configured to open the valve such that water is discharged through the cleaning nozzle when the voltage of the charging unit is lower than the predetermined reference voltage.

* * * * *